US005325786A

United States Patent [19]

Petrovich

[11] Patent Number: 5,325,786

[45] Date of Patent: Jul. 5, 1994

[54] FLECHETTE FOR A SHOTGUN

[76] Inventor: Paul A. Petrovich, 11269 Judd Rd., Fowlerville, Mich. 48836

[21] Appl. No.: 105,983

[22] Filed: Aug. 10, 1993

[51] Int. Cl.[5] ..... F42B 7/02

[52] U.S. Cl. ..... 102/438; 102/439; 102/460; 102/501; 102/703

[58] Field of Search ..... 102/430, 436, 438, 439, 102/448, 460, 494, 495, 496, 497, 501, 703; 244/3.23

[56] References Cited

U.S. PATENT DOCUMENTS

| | | | |
|---|---|---|---|
| 215,015 | 5/1879 | Merriam | 102/439 |
| 879,079 | 2/1908 | Bon | 244/3.1 |
| 1,166,360 | 12/1915 | Gregory | 102/439 |
| 2,014,367 | 2/1935 | Breegle | 102/430 |
| 3,673,047 | 6/1972 | Ruth et al. | 102/703 |
| 3,877,381 | 4/1975 | McCoy | 102/448 |
| 3,952,658 | 4/1976 | Broyles | 102/438 |
| 4,718,348 | 1/1988 | Ferrigno | 102/439 |

FOREIGN PATENT DOCUMENTS

| | | | |
|---|---|---|---|
| 207081 | 2/1909 | Fed. Rep. of Germany | 102/501 |
| 507889 | 9/1920 | France | 102/501 |
| 14118 | of 1896 | United Kingdom | 244/3.23 |

*Primary Examiner*—Harold J. Tudor

*Attorney, Agent, or Firm*—Peter A. Taucher; David L. Kuhn

[57] ABSTRACT

Disclosed is an improved design for individual flechettes, a multiplicity of which are arrayed in an ammunition cartridge for a gun. The flechettes have elongate solid bodies centered about a longitudinal axis, the bodies tapering from a waist to both forward end and rearward end. The waists of the flechettes are closer to the forward end than to the rearward end so that the flechettes' centers of gravity are closer to the forward ends than the rearward ends. The flechettes may have regular polygonal cross sections or essentially regular polygonal cross sections wherein the flechettes define fins along their bodies. Packing arrangements of the flechettes within ammunition cartridges are also shown.

4 Claims, 5 Drawing Sheets

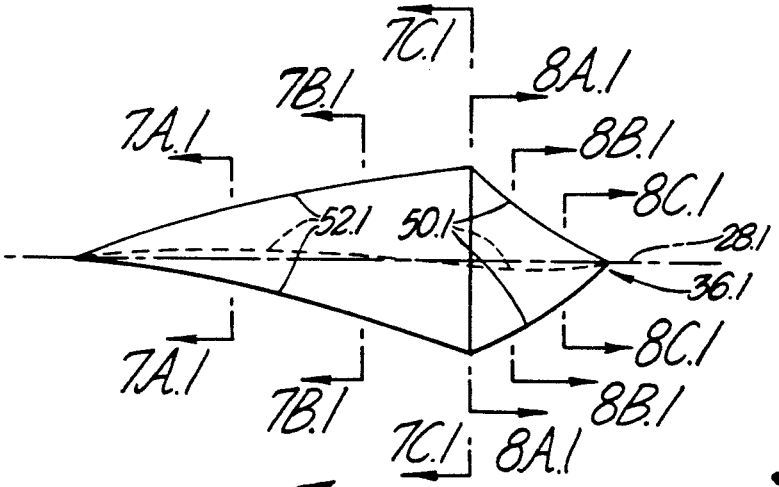
Fig.6.1
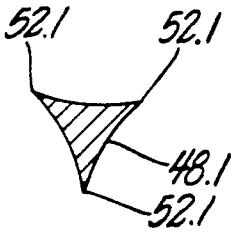
Fig.7A.1
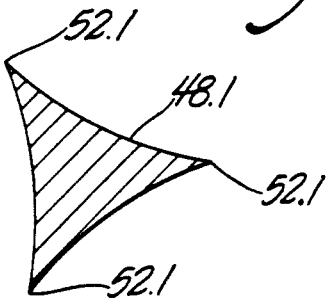
Fig.7B.1
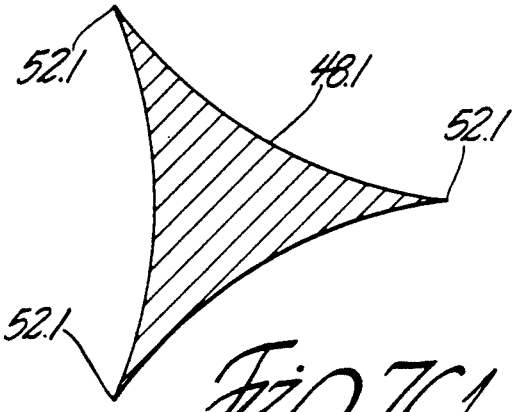
Fig.7C.1
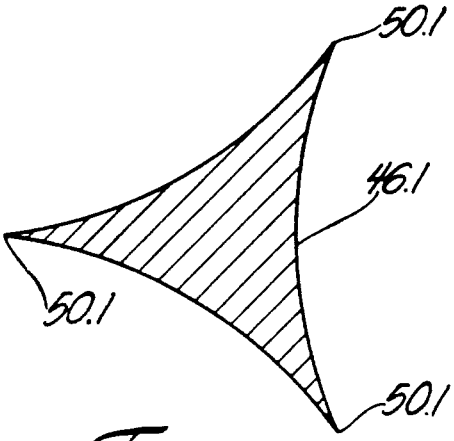
Fig.8A.1
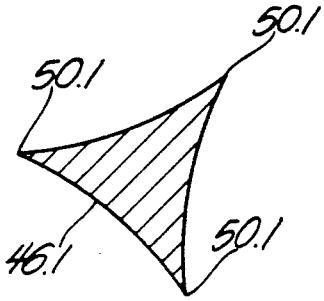
Fig.8B.1
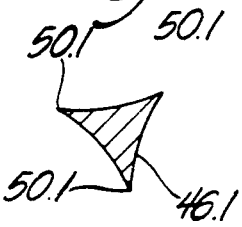
Fig.8C.1

FLECHETTE FOR A SHOTGUN

GOVERNMENT USE

The invention described herein may be manufactured, used and licensed by or for the U.S. Government for governmental purposes without payment to me of any royalty thereon.

BACKGROUND AND SUMMARY

My invention relates to ammunition for guns wherein a multiplicity of shot units, dispersing projectiles or the like are disposed within a shell. I disclose improved dispersing projectiles in the form of flechettes within a wad cup or a cylinder forming part of a cartridge fired from a gun. My flechettes can achieve more stable, aerodynamically efficient flight than known shot units or dispersing projectiles.

My flechettes are solid elongate bodies centered about their longitudinal axes. The flechettes each have waists between their fore and aft ends, and the flechettes taper from the waist to both ends. The waists are closer to the fore end than to the aft end so that the flechettes' centers of gravity are closer to the fore ends than the aft ends. My flechettes optionally have regular polygonal cross sections or essentially regular polygonal cross sections at all locations along their longitudinal axes, whereby the flechettes define longitudinal ridges acting as stabilizer fins. Also shown are arrays of the flechettes within ammunition casings cartridges.

BRIEF DESCRIPTION OF THE DRAWINGS

FIG. 6.1 is a side elevational view of a variation of the FIG. 6 flechette.

FIGS. 7A.1, 7B.1 and 7C.1 are representative cross sections aft of the waist around the FIG. 6.1 flechette. These figures are views taken along lines 7A.1—7A.1, 7B.1—7B.1 and 7C.1—7C.1, respectively in FIG. 6.1.

FIGS. 8A.1, 8B.1 and 8C.1 are representative cross sections in front of the waist of the FIG. 6.1 flechette and are views taken along lines 8A.1—SA.1, 8B.1—8B.1 and 8C.1—8C.1, respectively in FIG. 6.1.

DETAILED DESCRIPTION

Figure 1:
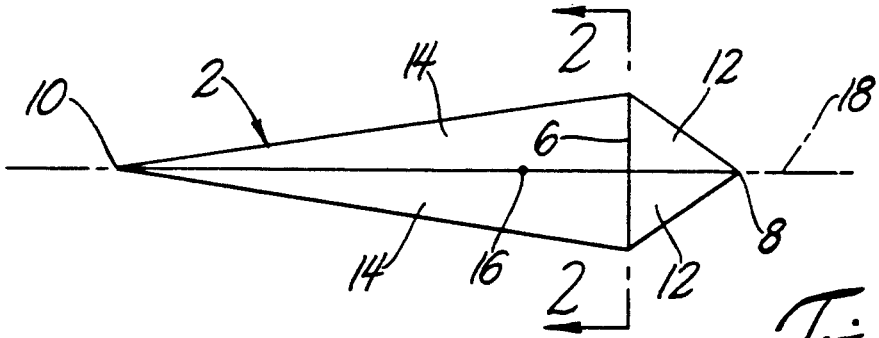
FIG. 1 is a side elevational view of a first embodiment of my flechette.
Figure 2:
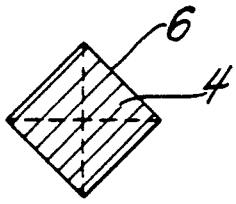
FIG. 2 is a view taken along line 2—2 in FIG. 1 and shows a cross section of the waist of the flechette in FIG. 1.
Figure 3:
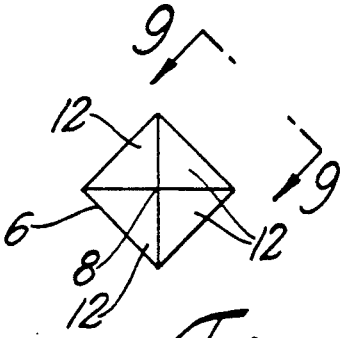
FIG. 3 is an front elevational view of the FIG. 1 Flechette.

FIG. 1 shows a first embodiment 2 of my improved, solid flechette having any regular polygonal cross section, which can be a square cross section 4 seen in FIG. 2. Flechette 2 tapers both forward and rearward from waist 6 respectively to points of nose 8 and terminus 10. The exterior of flechette 2 therefore consists of front triangular facets 12 and back triangular facets 14. The forward end of flechette 2 is blunter and shorter than the back end, and the flechette's center of gravity 16 is closer to nose 8 than terminus 10, the center of gravity being on the flechette's central axis 18. The relatively forward location of the flechette's center of gravity keeps the nose of the flechette forward during flight from a gun barrel toward a target.

Figure 4:
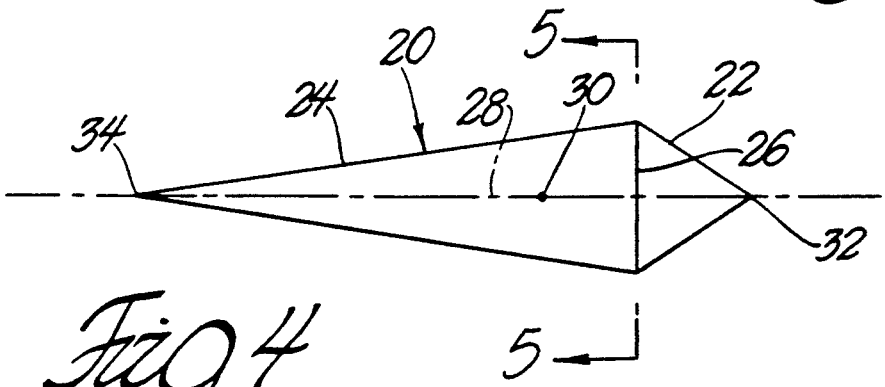
FIG. 4 is a side elevational view of a second embodiment of my flechette.
Figure 5:
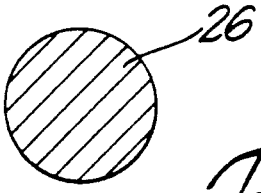
FIG. 5 is a view taken along line 5—5 in FIG. 4.

FIGS. 4 and 5 show an alternate embodiment 20 of my flechette comprised of two solid cones congruently and integrally joined at waist 26, the cones being centered about axis 28. Rear cone 24 is longer and more gently tapered than front cone 22, and center of gravity 30 is closer to frontal nose 32 than to rear terminus 34. The noses and termini of both flechette 2 and flechette 20 may optionally be rounded.

Figure 6:
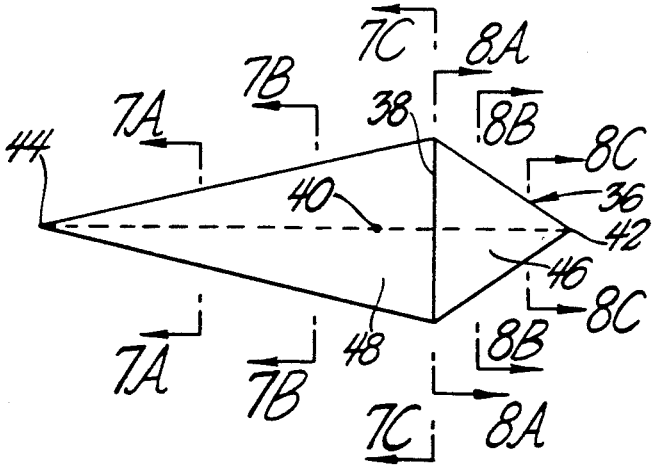
FIG. 6 is a side elevational view of a third embodiment of my flechette.
Figure 8A:
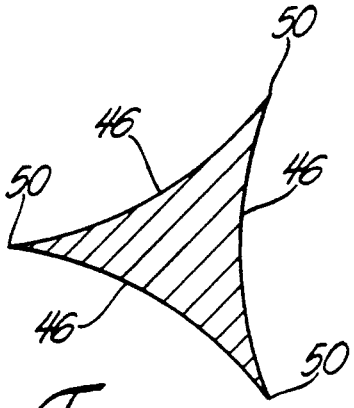
FIGS. 8A, 8B and 8C are representative cross sections ahead of the waist around the FIG. 6 flechette. These figures are views taken along lines 8A—8A, 8B—8B and 8C—8C, respectively in FIG. 6.
Figure 8B:
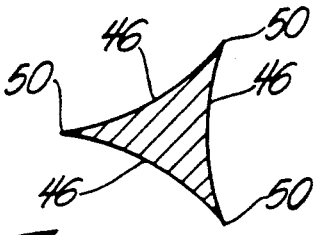
Figure 8C:
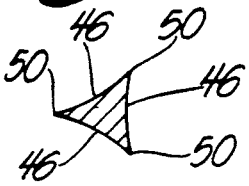

FIG. 6 shows another embodiment 36 of my flechette having waist 38 and center of gravity 40 closer to nose 42 than rear terminus 44. As with the prior embodiments, flechette 36 tapers both rearward and forward from the waist, the shorter and blunter taper being from the waist to the nose. The distinctive feature of flechette 36 is the concavity of its facets forming the exterior surface of the flechette. The concavity of front facets 46 can be seen in FIGS. 8A, 8B and 8C, and the concavity of rear facets 48 can be seen in FIGS. 7A, 7B and 7C. Flechette 36 defines a set of frontal straight ridges 50 at the edge zones of facets 46 and defines a set of rear straight ridges 52 at the edge zones of facets 48. The ridges act as fins to stabilize flechette 36 during its flight.

Figure 7A:
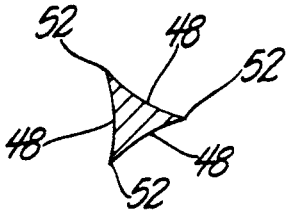
FIGS. 7A, 7B and 7C are representative cross sections aft of the waist around the FIG. 6 flechette. These figures are views taken along lines 7A—7A, 7B—7B and 7C—7C, respectively in FIG. 6.
Figure 7B:
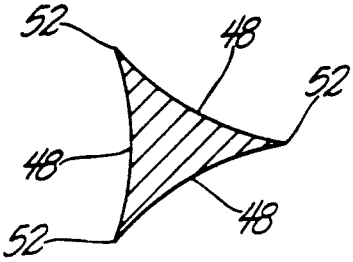
Figure 7C:
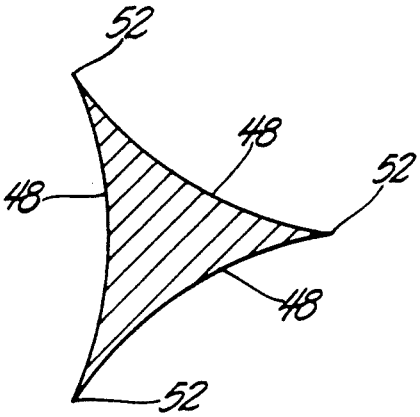
Figure 9:
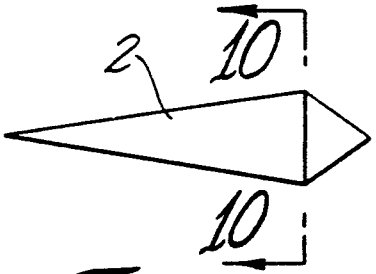
FIG. 9 is a view taken along line 9—9 in FIG. 3.
Figure 10:
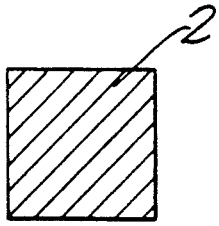
FIG. 10 is a view taken along line 10—10 in FIG. 9.

In FIG. 6.1 is show a variation 36.1 of the FIG. 6 flechette wherein flechette 36.1 has a slight helical twist about longitudinal central axis 28.1. Ridges 50.1 and 52.1 are helical fins that will impart spin to flechette 36.1 so that this flechette will be a more stable projectile during flight. FIGS. 7A.1, 7B.1 and 7C.1 are analogues of FIGS. 7A, 7B and 7C, respectively, and show ridges 52.1. Likewise, FIGS. 8A.1, 8B.1 and 8C.1 are analogues of FIGS. 8A, 8B and 8C, respectively, and show ridges 50.1. It is not necessary that facets 46.1 and 48.1 respectively between ridges 50.1 and 52.1 be concave, but instead, these facets may be flat.

Figure 11:
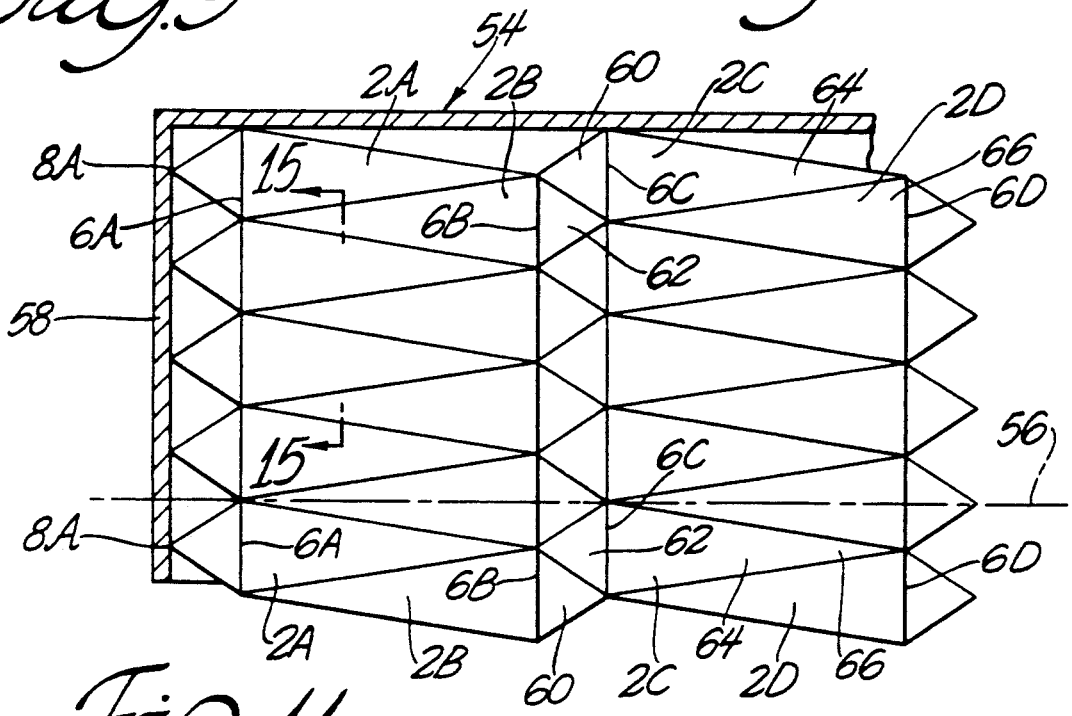
FIG. 11 is a partial sectional view of an ammunition casing having my flechettes arrayed therein.
Figure 15:
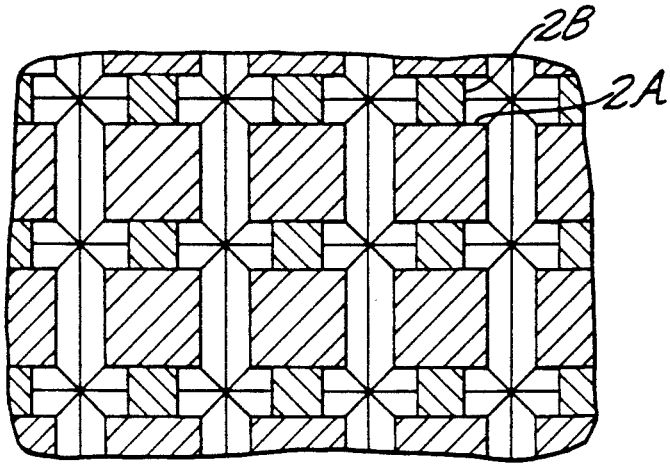
FIG. 15 is a view taken along line 15—15 in FIG. 11.
Figure 12:
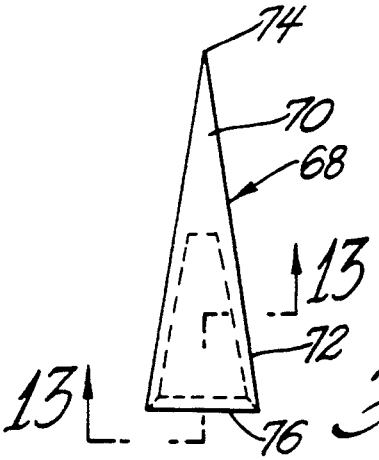
FIG. 12 is a side elevational view of an additional flechette that may be used with the FIG. 1 flechette in an ammunition casing.

FIG. 11 shows a multiplicity of flechettes 2A, 2B, 2C and 2D packed within a cylindrical holder or casing 54 which can be similar to a casing or holder for shot in a shotgun cartridge or can also be a much larger casing. Likewise, the individual flechettes can be comparable in size to the individual balls of shot of a shotgun shell but can be several centimeters in length or longer. Flechettes 2A, 2B, 2C and 2D are all the same as flechette 2 and are all oriented parallel to central longitudinal axis 56 of casing 54.

Flechettes 2A form a first array wherein waists 6A lie in a first common plane and noses 8A are all oriented in the same direction. FIG. 11 shows noses 8A contacting axial wall 58 of casing 54, but flechettes 2A can optionally be oriented so that their opposite, rearward ends contact wall 58. Meshed and closely fit with the flechettes 2A of the first array are reversely oriented flechettes 2B of a second array, wherein waists 6B are in a second common plane and the rear ends of flechettes 2B interdigitate with the rear ends of flechettes 2A. Similarly meshed and closely fit together are the forward ends 60 of flechettes 2C with forward ends 62 of flechettes 2B, and rearward ends 64 of flechettes 2C are meshed with rearward ends of flechettes 2D. Flechettes 2C form a third array wherein waists 6C lie in a third common plane and flechettes 2D form a fourth array wherein waists 6D lie in a fourth common plane.

Figure 13:
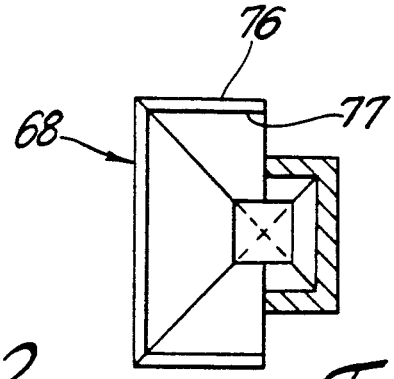
FIG. 13 is a view taken along line 13—13 in FIG. 12.
Figure 14:
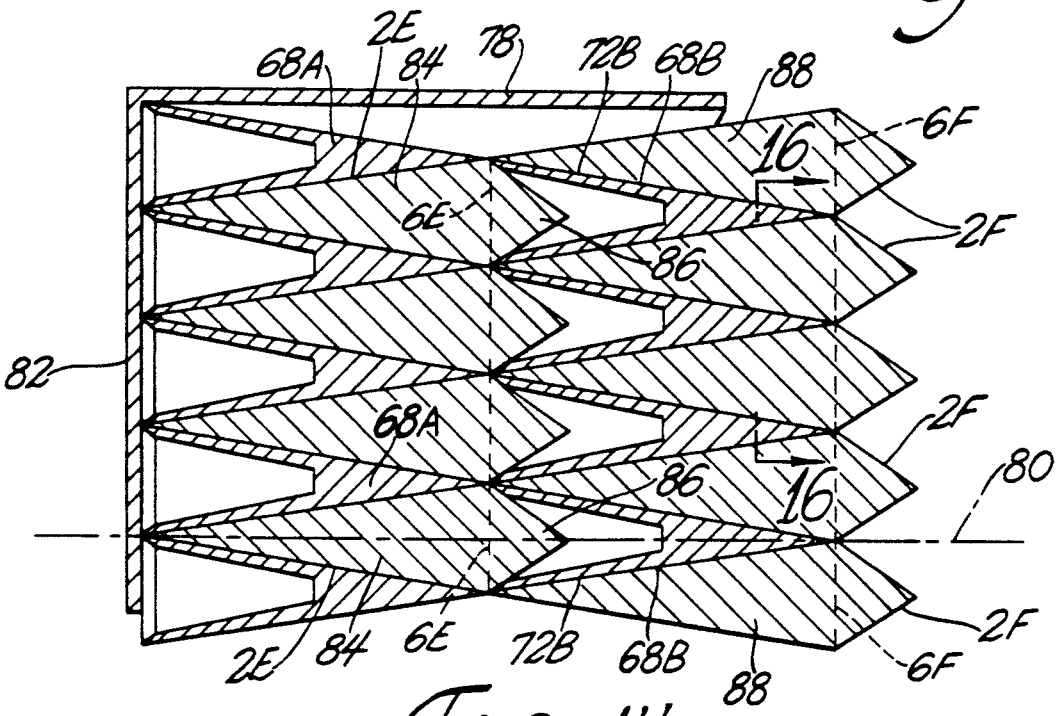
FIG. 14 is a partial sectional view of another ammunition casing having FIG. 1 and FIG. 12 flechettes arrayed therein.
Figure 16:
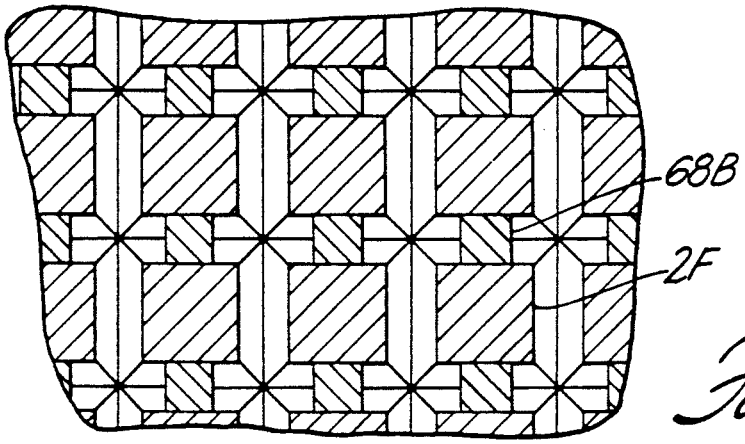
FIG. 16 is a view taken along line 16—16 in FIG. 14.

FIG. 14 shows an alternate flechette packing arrangement utilizing the FIG. 13 pyramidal flechettes 68 interdigitated with flechettes 2E and 2F, which are the same as flechette 2 in FIG. 1. As seen in FIG. 13, flechette 68, which is exemplary of flechettes 68A and 68B, is essentially an elongate square pyramid having a solid front or apex portion 70 and a hollow lower or rear base region 72. Flechette 68 has a center of gravity closer to tip 74 than to base 76, which defines opening 77.

Turning again to FIG. 14, there is shown a partial sectional view of a cylinder or casing 78 centered on longitudinal axis 80. Contacting the rear axial wall 82 of the casing are bases of a first set of pyramidal flechettes 68A, the bases of pyramidal flechettes 68A being adjacent one another. Meshing and closely fit in interdigitating fashion with flechettes 68A are the rearward ends 84 of flechettes 2E such that the tips of flechettes 68A are at waists 6E of flechettes 2E which waists lie in a common plane.

The forward ends 86 of flechettes 2E extend into hollow base portions 72B of pyramidal flechettes 68B such that the openings at the bases of the pyramidal flechettes mate with the waists 6E of flechettes 2E. Meshing and closely fit in interdigitating fashion with flechettes 68B are the rearward ends 88 of flechettes 2F such that the tips of flechettes 68B are at waists 6F of flechettes 2F which lie in a common plane.

I wish it to be understood that I do not desire to be limited to the exact details of construction or method shown herein since obvious modifications will occur to those skilled in the relevant arts without departing from the spirit and scope of the following claims.

I claim:

1. An arrangement of flechettes in a cylinder, comprising:

individual flechettes each having a solid elongate body;

a front end of the solid body;

a rear end of the solid body;

a waist on the solid body closer to the front end than the rear end, the solid body tapering from the waist to the ends;

a center of gravity in the solid body closer to the front end than the rear end other flechettes each having a generally pyramidally shaped body having an apex and a base;

a solid portion of the pyramidally shaped body extending from the apex toward the base;

a hollow portion of the pyramidally shaped body between the solid portion and the base;

a center of gravity of the pyramidally shaped body closer to the apex than the base said other flechettes interdigitated with the individual flechettes.

2. The structure of claim 1, further including:

longitudinal axes of the individual flechettes;

longitudinal axes of the other flechettes;

an array of the individual flechettes wherein the waists of the individual flechettes lie in a first common plane perpendicular to the longitudinal axes of the individual flechettes and the rear ends of the individual flechettes terminate in a second common plane parallel to the first common plane;

a fore end of the cylinder, the first common plane being closer to the fore end than the second common plane;

an array of the other flechettes wherein the apexes of the other flechettes lie closer to the first common plane than to the second common plane, and the bases of the other flechettes are closer to the second common plane than to the first common plane;

whereby the centers of gravity of the flechettes in the arrays are closer to the first common plane than to the second common plane.

3. The structure of claim 1, further comprising:

a first array of the individual flechettes wherein the waists of first arrayed individual flechettes lie in a first common plane and the rear ends of the first arrayed individual flechettes terminate in a second common plane;

a first array of the other flechettes interdigitated with the first array of the individual flechettes wherein first arrayed other flechettes are disposed between the first and second common planes;

a second array of the individual flechettes wherein the waists of second arrayed individual flechettes lie in the second common plane;

wherein the rear ends of the second arrayed individual flechettes terminate in a third common plane and are oriented away from the first common plane;

wherein the front ends of the second arrayed individual flechettes protrude into the hollow portions of the first arrayed other flechettes;

a second array of the other flechettes interdigitated with the second array of the individual flechettes.

4. An array of gun shot bodies in a cylinder, comprising:

a central axis of the cylinder;

longitudinal axes parallel to the central axis;

flechettes placed along and centered on the longitudinal axes;

noses of the flechettes;

tails of the flechettes;

waists of the flechettes between the noses and the tails, the flechettes tapering from the waists to the noses and tails, said waists being closer to the noses of the flechettes than the tails of the flechettes, a center of gravity within each flechette along a longitudinal axis closer to the nose of the flechette than the tail of the flechette;

the waists of first flechettes being in a first plane so that noses of the first flechettes are on a same side of the first plane;

the waists of second flechettes being in a second plane so that noses of the second flechettes are on a same side of the second plane;

the waists of third flechettes being in a third plane so that noses of the third flechettes are on a same side of the third plane;

wherein the first flechettes interdigitate with the second flechettes and the second flechettes interdigitate with both the first and third flechettes;

tail facets of the first flechettes between the waists and tails of the first flechettes;

tail facets of the second flechettes between the waists and tails of the second flechettes;

first flat interfaces between the tail facets of the first flechettes and the tail facets of the second flechettes;

nose facets of the second flechettes between the waists and noses of the second flechettes;

nose facets of the third flechettes between the waists and noses of the third flechettes;

second flat interfaces between the nose facets of the second flechettes and the nose facets of the third flechettes.

* * * * *